US006616481B2

(12) United States Patent
Ichio

(10) Patent No.: US 6,616,481 B2
(45) Date of Patent: Sep. 9, 2003

(54) CONNECTOR

(75) Inventor: Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/090,071

(22) Filed: Mar. 1, 2002

(65) Prior Publication Data

US 2002/0127913 A1 Sep. 12, 2002

(30) Foreign Application Priority Data

Mar. 2, 2001 (JP) ..... 2001-059077
Jan. 31, 2002 (JP) ..... 2002-024504

(51) Int. Cl.[7] ..... H01R 13/40
(52) U.S. Cl. ..... 439/595; 439/752; 439/689
(58) Field of Search ..... 439/689, 595, 439/752

(56) References Cited

U.S. PATENT DOCUMENTS 5,167,534 A * 12/1992 Ohsumi ..... 439/595
5,692,929 A 12/1997 Hoffmann ..... 439/595
5,782,657 A * 7/1998 Wolla et al. ..... 439/595
5,913,697 A * 6/1999 Myer et al. ..... 439/595
6,193,551 B1 2/2001 Yamamoto et al.

FOREIGN PATENT DOCUMENTS

JP 01-177877 12/1989
JP 03-205770 9/1991

* cited by examiner

*Primary Examiner*—Alexander Gilman
(74) *Attorney, Agent, or Firm*—Gerald E. Hespos; Anthony J. Casella

(57) ABSTRACT

A connector has a housing (10) with a terminal accommodating portion (11) for receiving terminal fittings (13) and a receptacle (12) that surrounds the terminal accommodating portion (11). A holder (50) is mounted on the terminal accommodating portion (11) from the front and includes a front wall (51) for supporting the terminal fitting (13) at their front limit positions. A retainer (40) is mounted sideways through a retainer insertion hole (33) in the receptacle (12) and into a retainer mount hole (26) in the terminal accommodating portion (11) for locking the terminal fittings (13). The terminal accommodating portion (11) has a holding groove (29) for holding the holder (50). The holding groove (29) is exposed laterally through the retainer mount hole (26) and the retainer insertion hole (33). The holding grooves (29), the retainer mount hole (26) and the retainer insertion hole (33) are molded by the same mold when the housing (10) is molded.

7 Claims, 20 Drawing Sheets

(A)

(B)

CONNECTOR

BACKGROUND OF THE INVENTION

1. Field of the Invention

The present invention relates to a connector.

2. Description of the Related Art

A known connector has a synthetic resin housing is identified by the numeral 1 in FIG. 20A. The housing 1 has opposite front and rear ends and a cavity 2 that extends through the housing 1 from the front end to the rear end. A lock 3 projects from an inner surface of the cavity 2 and a front stop wall 4 is formed in the cavity 2 near the front end of the housing 1. The lock 3 is deformed resiliently in response to forces exerted by a terminal fitting inserted into the cavity 2 from behind. However, the lock 3 is restored resiliently when the terminal fitting reaches the front stop wall 4. Thus, the lock 3 holds the terminal fitting in the cavity 2. The housing 1 is formed by placing molds 5, 6 before and behind the lock 3 and the front-stop wall 4 and filling the molds 5, 6 with a molted resin. The molds 5, 6 are withdrawn after a molten resin has solidified.

U.S. Pat. No. 6,193,551 discloses a connector that attempted to make the above-described connector smaller. This connector is formed by molding a part of a housing 1 that includes the lock 3, separately molding a part of the housing 1 that includes the front-stop wall 4 and then assembling the two parts together as shown in FIG. 20(B). This eliminates an undesirable reduction in the area of the front-stop wall 4 caused by the fact that the mold 5 provided before the lock 3 in the above connector is withdrawn as shown in FIG. 20(A). Thus, the front-stop wall 4 can be secure even if the width of the cavity 2 is small. In this connector as well, the locking portion 3 and left and right side walls 7 adjacent to the lock 3 are spaced apart to permit the resilient deformation of the lock 3. As a result, clearances of width Tb are defined between the lock 3 and the opposite side walls 7.

Some known connector housings include a terminal accommodating portion into which terminal fittings are inserted. These known connector housings also have a receptacle that surrounds the terminal accommodating portion. A rubber ring may be mounted on the outer surface of the terminal accommodating portion if the connector is required to be watertight. A mating housing is inserted between the terminal accommodating portion and the receptacle and closely engages the rubber ring to make the connector watertight.

The above described watertight connector can be made smaller by providing a holding member that has a front-stop wall, and mounting the holding member onto the terminal accommodating portion from the front. However, the terminal accommodating portion must have a holding portion of a specified shape to hold the holding member mounted on the terminal accommodating portion.

The present invention was developed in view of the above problems, and an object thereof is to provide a watertight connector that can be produced easily.

SUMMARY OF THE INVENTION

The invention is directed to a connector with a housing that has a terminal accommodating portion and a receptacle that at least partly surrounds the terminal accommodating portion. At least one terminal fitting is insertable into the terminal accommodating portion. The housing further includes a holder mounted on the terminal accommodating portion. The holder has a stop wall for supporting the terminal fitting at a limit position. The terminal accommodating portion comprises a holding portion for securely mounting the holder. The holding portion is exposed along a direction that intersects a fitting direction for the holder onto the terminal accommodating portion, and preferably the holding portion is exposed substantially sideways, to outside through a side hole. The holding portion preferably can be molded by a mold that is removable through the side hole.

The connector may further comprise a retainer for engaging and locking the terminal fitting. The retainer is mountable to the terminal accommodating portion in a direction that intersects the insertion direction of the terminal fittings. Preferably, the retainer is mountable substantially sideways through a retainer insertion hole in the receptacle.

The side hole preferably serves as the retainer insertion hole for inserting the retainer into the terminal accommodating portion. Accordingly, it is possible to mold a holding portion without a separate mold-removal hole in the housing that is specially tailored for the holding portion.

The receptacle is formed with a retainer insertion hole to mount the retainer preferably into the terminal accommodating portion substantially sideways. The mold for molding the holding portion can be removed through the retainer insertion hole as part of an existing construction. Thus, the holding portion can be molded without forming a special mold-removal hole.

The connector preferably comprises a sealing ring mounted behind the holding portion on the outer surface of the terminal accommodating portion for being squeezed between the housing and a mating housing that is inserted between the terminal accommodating portion and the receptacle.

The holding portion preferably is a groove in the outer surface of the terminal accommodating portion and opens laterally or along a direction that intersects a holder fitting direction. The holder has at least one projection engageable with the holding portion.

The sealing ring passes the holding portion while being mounted on the terminal accommodating portion. Since the holding portion is groove-shaped, the holding portion is less likely to get caught by the sealing ring as compared to a case where the holding portion is in the form of a projection. Thus, a good mounting operability is provided.

The groove that defines the holding portion may comprise a front end surface arranged at an angle between about 70° to about 110° with respect to the holding member fitting direction, and preferably substantially normal thereto. The front end surface engages a mating surface of the projection that has substantially the same angle as the front end surface.

The projection may comprise a slanted portion for coming into sliding contact with a corresponding portion of the terminal accommodating portion.

The terminal accommodating portion may comprise guiding means for guiding the mounting of the holding member.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
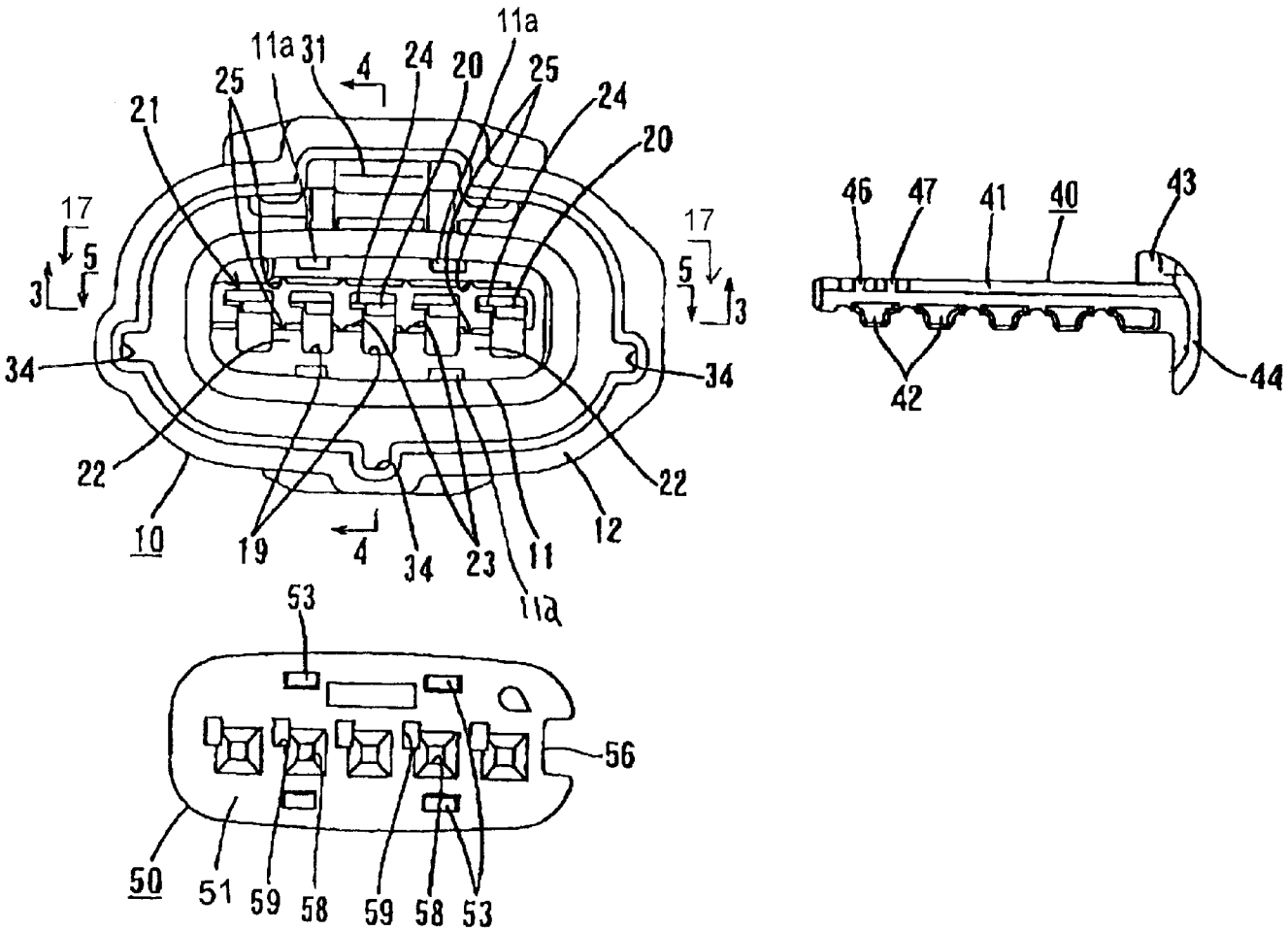
FIG. 1 is a front view of a housing main body, a holding member and a retainer according to one embodiment of the invention.
Figure 3:
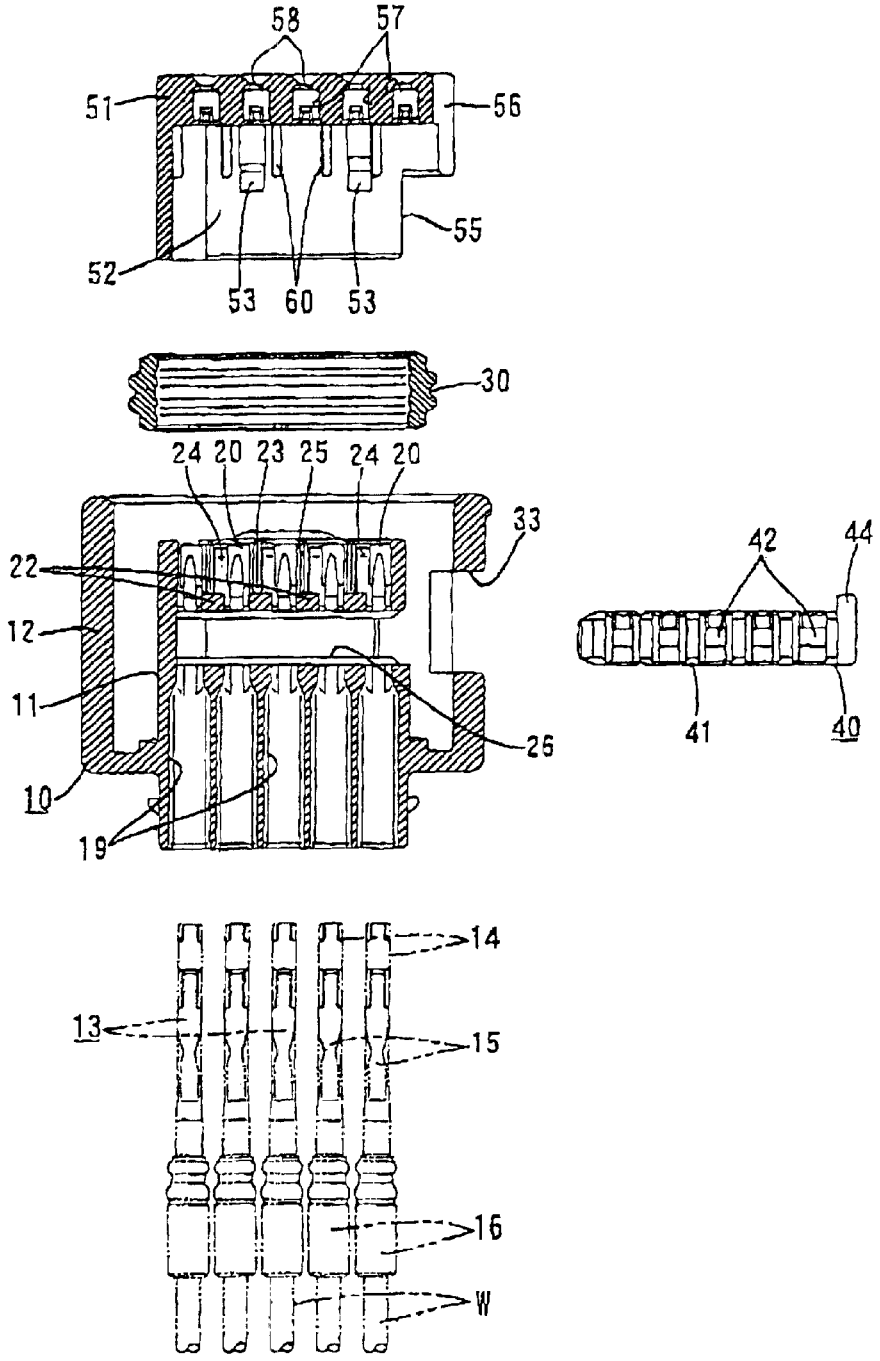
FIG. 3 is a section along 3—3 of FIG. 1 showing an exploded state of a female connector.
Figure 4:
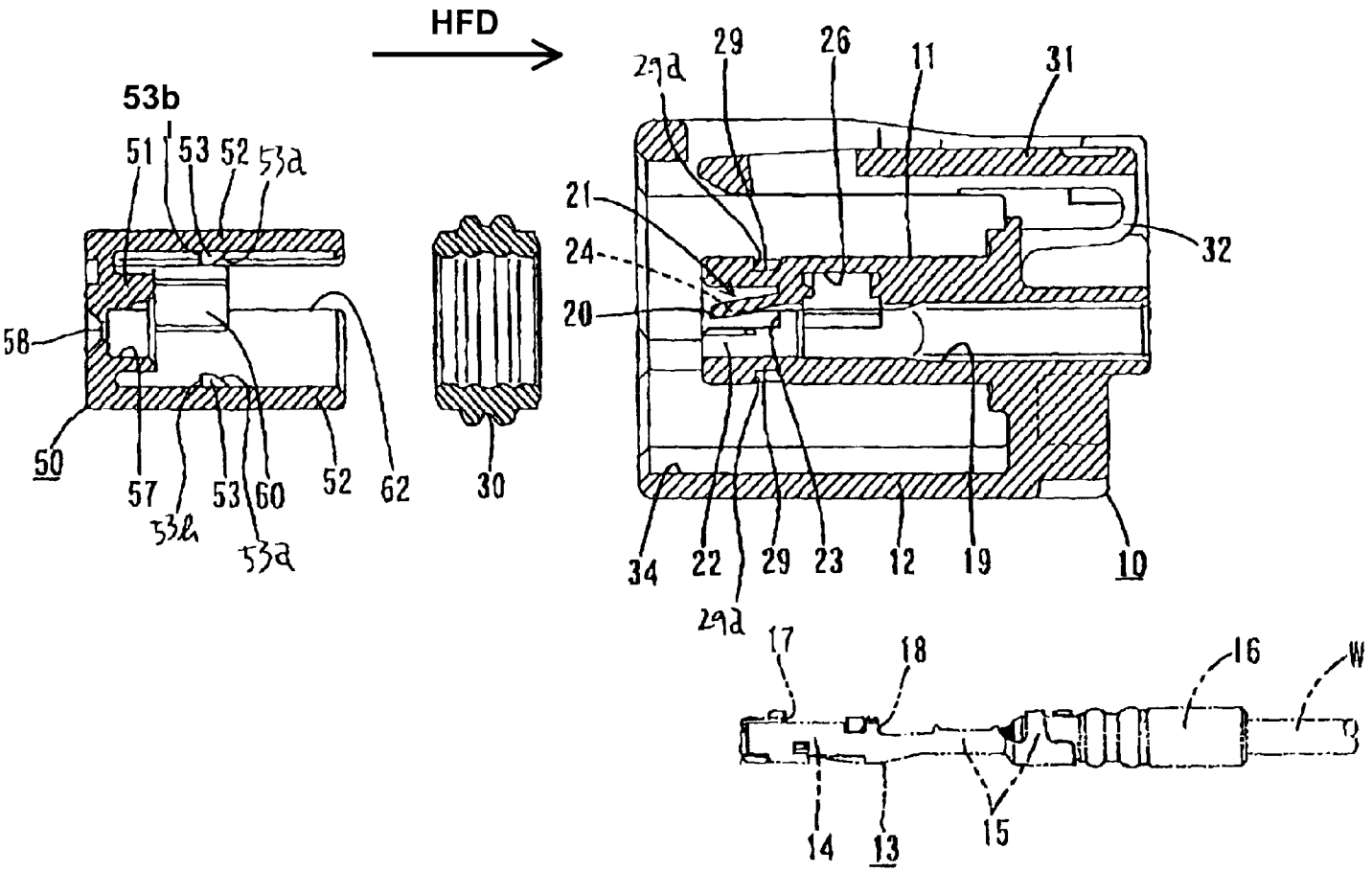
FIG. 4 is a section along 4—4 of FIG. 1 showing the exploded state of the female connector.

A female connector in accordance with the invention includes a housing 10, as shown in FIG. 1. The housing 10 is made of a synthetic resin and includes a terminal accommodating portion 11. The housing 10 also includes a receptacle 12 that surrounds a front end of the terminal accommodating portion 11, as shown in FIGS. 3 and 4. The terminal accommodating portion 11 accommodates terminal fittings 13, each of which has a substantially box-shaped connecting portion 14 and a barrel 15 that is crimped into connection with an end of a wire W. A rubber plug 16 is fitted on an end of the insulation coating of the wire W and is crimped by the barrel 15.

Five cavities 19 are arrayed laterally in the housing 10 and are dimensioned to receive the terminal fittings 13 from behind, as shown in FIG. 3. A front half of each cavity 19 has a substantially rectangular cross section that conforms to the shape of the connecting portion 14 of the terminal fitting 13. A rear half of each cavity 19 has a circular cross-section that conforms to the shape of the rubber plug 16. Thus, the rubber plug 16 is held close to the inner surface of the cavity 19 to protect the inside of the cavity 19 from water.

A lock 20 is cantilevered from an upper front of each cavity 19 and intersects an inserting direction ID of the terminal fitting 13, as shown in FIG. 4. The lock 20 is deformed resiliently in a deformation direction DD and into a deformation permitting space 21 during insertion of the terminal fitting 13 into the cavity 19. However the lock 20 is restored resiliently substantially to its original shape when the terminal fitting 13 reaches a proper depth and engages a projection 17 on the upper surface of the engaging portion 14. At this time, the terminal fitting 13 is accommodated in the cavity 19 and its front end projects forward from the terminal accommodating portion 11.

The front halves of adjacent cavities 19 are partitioned by partition walls 22, each of which is slightly narrower than the front half of the corresponding cavity 19. Each partition wall 22 has a notch 23 that opens forwardly from the base end of the lock 20. Each notch 23 is disposed at the upper part of the partition wall 22 and extends over more than half the height of the partition wall 22, as shown in FIG. 1. Thus, each notch 23 extends from the upper end of the partition wall 22 to a position below the bottom end of the lock 20. Substantially V-shaped positioning grooves 25 are formed in the upper and lower surfaces of the notches 23.

An unlocking piece 24 is coupled to a side surface of the lock 20 over substantially its entire length and projects from the back end of each notch 23. The unlocking piece 24 can be pressed with a jig to disengage the lock 20 from the terminal fitting 13. The unlocking piece 24 is about half as wide as the respective notch 23.

Figure 5:
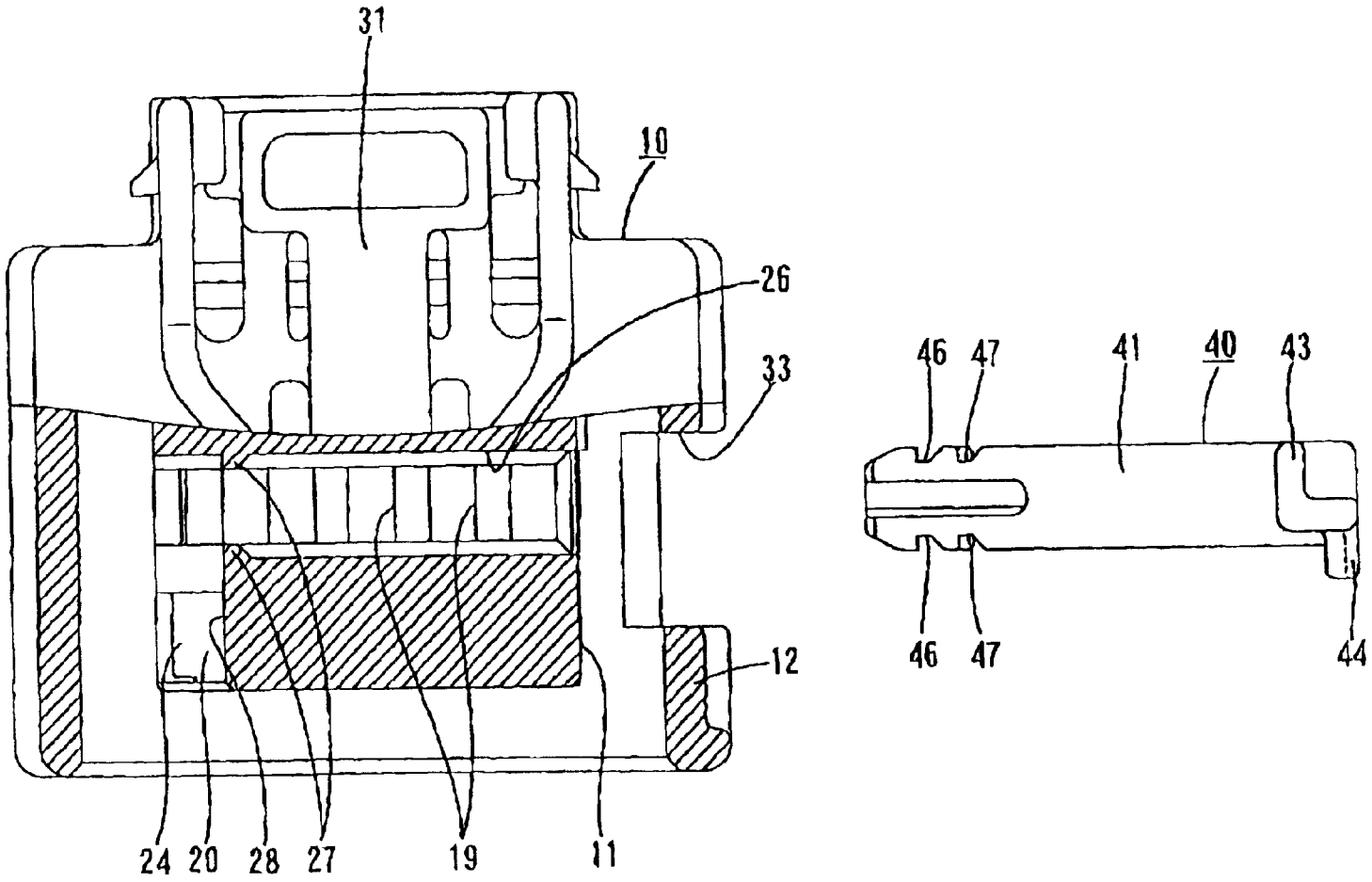
FIG. 5 is a section along 5—5 of FIG. 1 showing the housing main body and the retainer.

A retainer mount hole 26 penetrates the terminal accommodating portion 11 transversely and communicates with the cavities 19 at a position slightly behind the locks 20, as shown in FIGS. 3 and 4. Front and rear holding projections 27 project at the rear side of the retainer mount hole 26, as shown in FIG. 5, and a mold removal hole 28 opens forwardly at the front side of the holding projections 27 for forming the back end surfaces of the holding projections 27. Two laterally-extending holding grooves 29 are formed in each of the upper and lower surfaces of the terminal accommodating portion 11, as shown in FIG. 4, and open sideways. The holding grooves 29 intersect the holding member fitting direction HFD and preferably are substantially normal thereto. Additionally, a front end surface 29*a* of each holding groove 29 is substantially normal to the holding member fitting direction HFD. Further, two slanted surfaces 11*a* are formed respectively at the upper and lower sides of the front end surface of the terminal accommodating portion 11.

The receptacle 12 is a forwardly open rectangular tube that is coupled to the terminal accommodating portion 11 by a coupling portion that bulges out near the rear of the terminal accommodating portion 11. A mating male connector (not shown) can be inserted between the receptacle 12 and the terminal accommodating portion 11 from the front. A rubber ring 30 is fitted on the outer surface of the terminal accommodating portion 11 and can be squeezed tightly between the terminal accommodating portion 11 and the male connector to provide a watertight fit between the connectors. A lock arm 31 is provided substantially at a widthwise center of the upper part of the receptacle 12 for holding the male connector connected.

Figure 2:
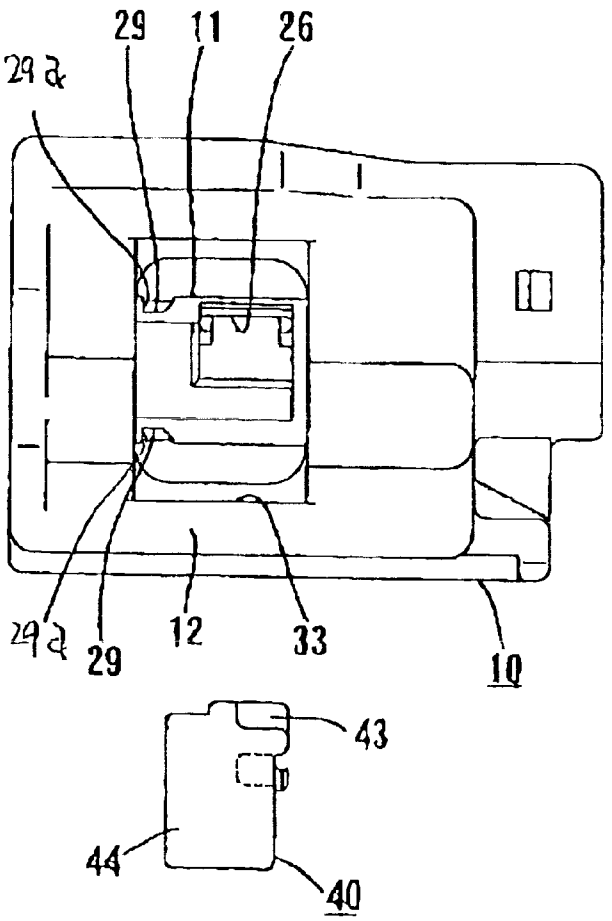
FIG. 2 is a side view of the housing main body, the holding member and the retainer.
Figure 2:
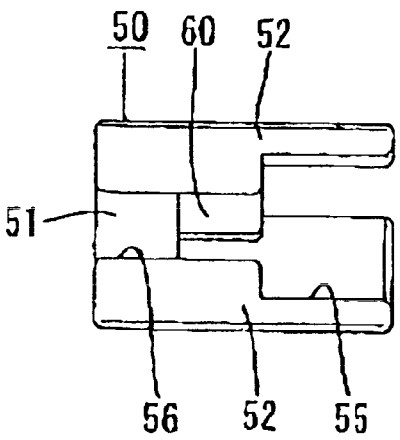
Figure 17:
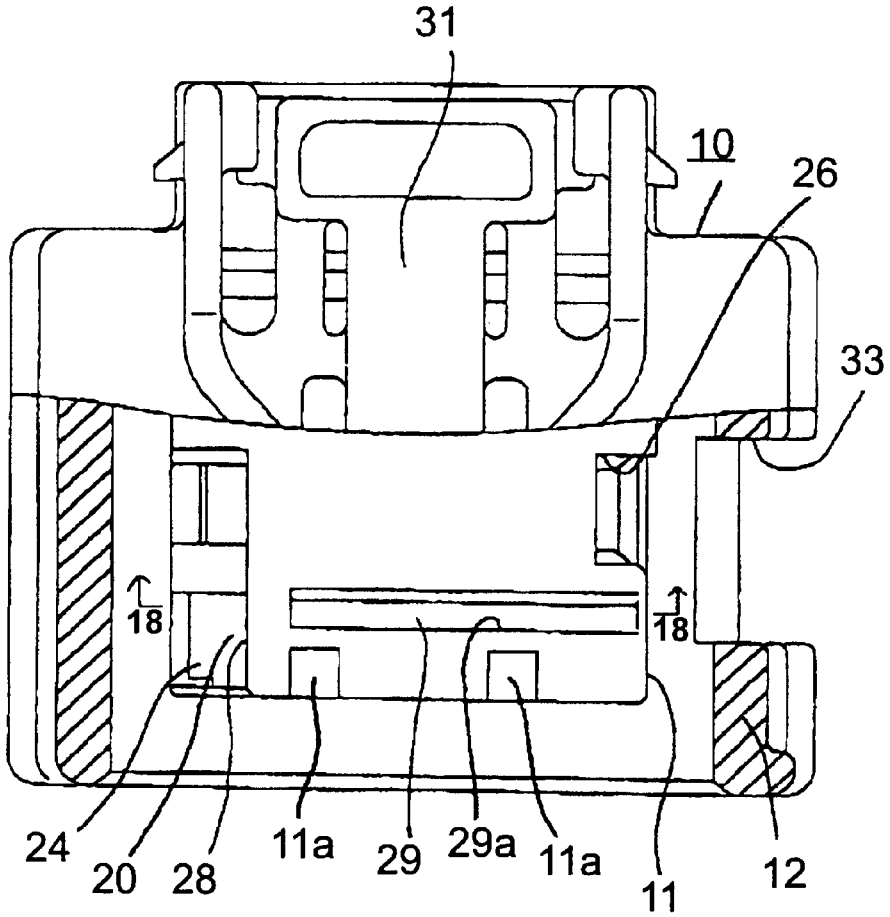
FIG. 17 is a section of the housing main body along 17—17 of FIG. 1.
Figure 18:
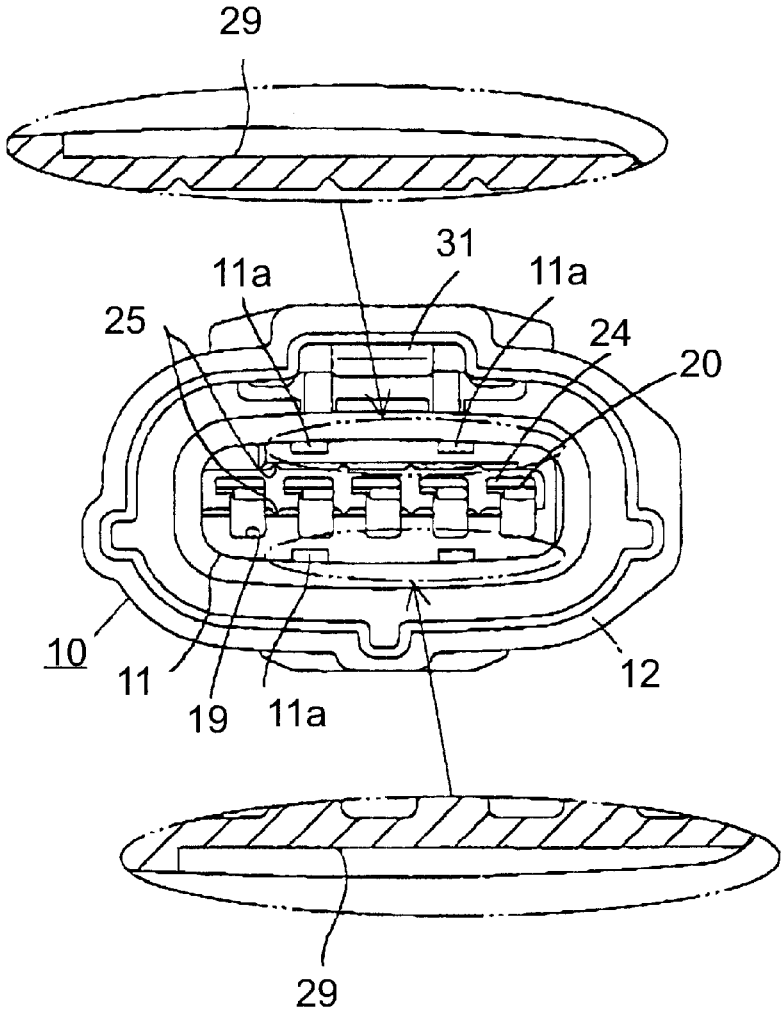
FIG. 18 is a front view partly in enlarged section along 18—18 of FIG. 17 showing essential portions of the housing main body.
Figure 19:
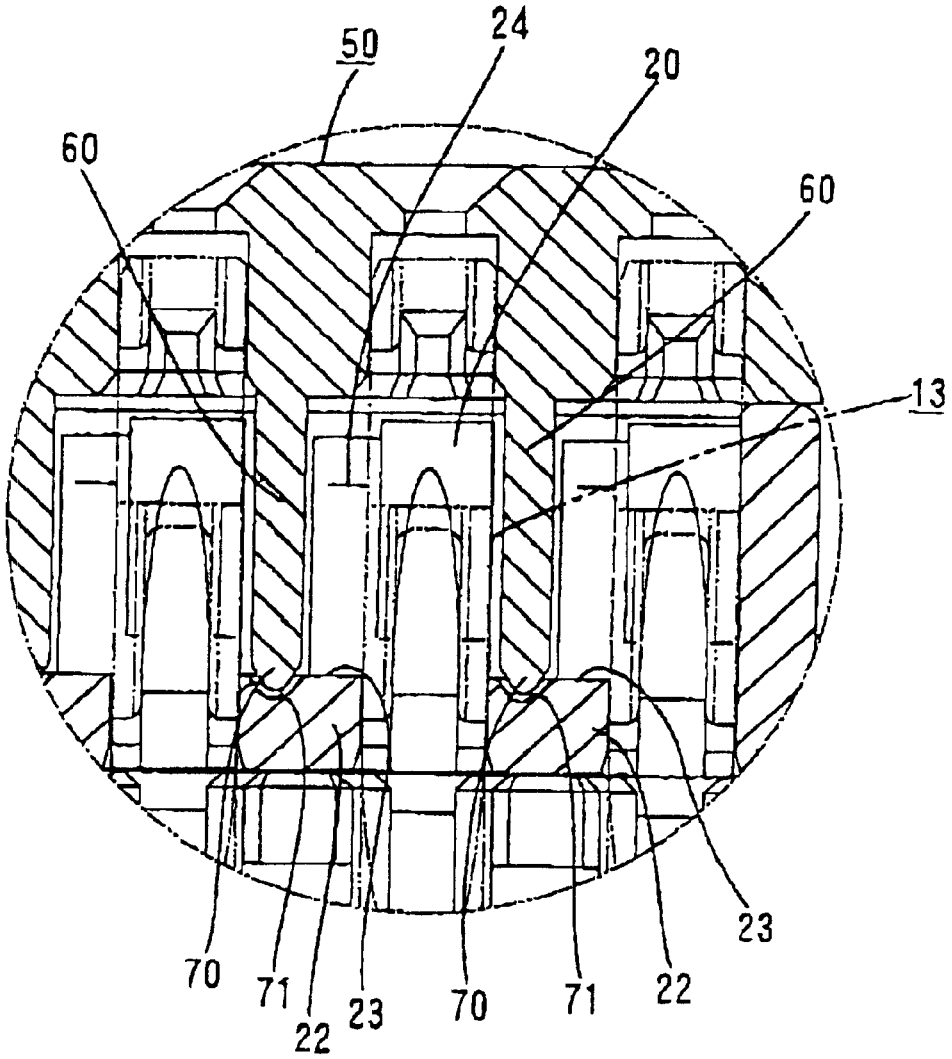
FIG. 19 is an enlarged horizontal section of a modification.
Figure 20:
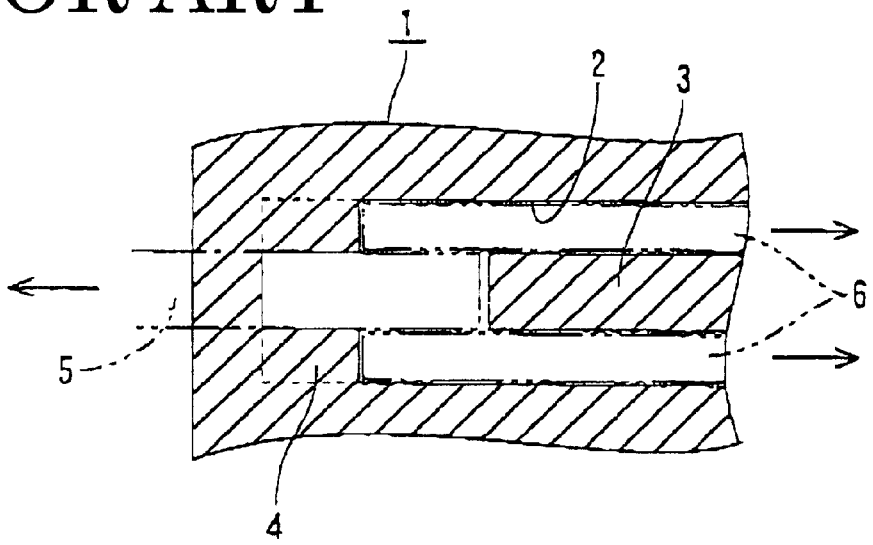
FIG. 20 PRIOR ART
FIG. 20(A) is a diagram of a generally used prior art connector.
FIG. 20(B) is a diagram showing an improvement made to make the connector of FIG. 20(A) smaller.
Figure 20:
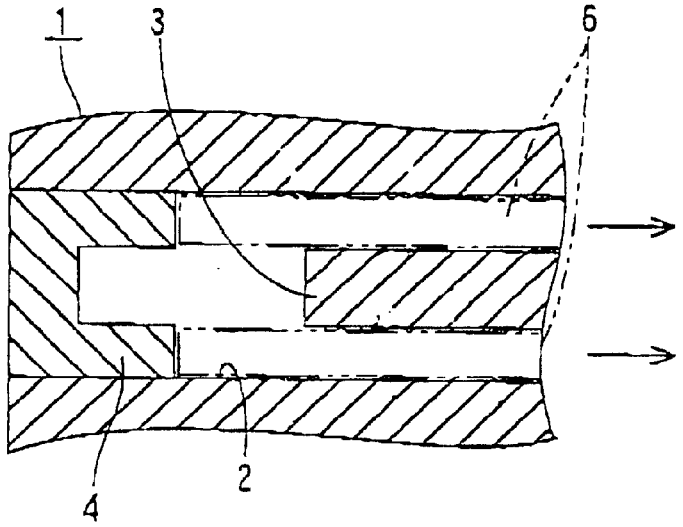
FIG. 20 PRIOR ART

The lock arm 31 has its rear end coupled to the terminal accommodating portion 11 by two support arms 32 and has opposite lateral edges partially coupled to the receptacle 12 as shown in FIG. 5. Thus the lock arm 31 is vertically resiliently displaceable. A retainer insertion hole 33 opens at the right side of the receptacle 12 in FIG. 5. As shown in FIGS. 2 and 17, the retainer mount hole 26 of the terminal accommodating portion 11 and the holding grooves 29 are exposed to the outside through the retainer insertion hole 33. The retainer insertion hole 33, the retainer mount hole 26 and the holding grooves 29 are formed by the same mold when the housing 10 is molded. Thus, the mold for molding the retainer insertion hole 33, the retainer mount hole 26 and the holding grooves 29 can be removed laterally when the mold is opened, and sections of this mold for molding the retainer mount hole 26 and the holding grooves 29 are removed sideways through the retainer insertion hole 33. Opposite sides and the bottom of the receptacle 12 are formed to bulge out as shown in FIG. 1, and hence to form three guide grooves 34 for guiding the connection of the male connector.

A retainer 40 is made e.g. of a synthetic resin and has a narrow plate-shaped base 41 for insertion into the retainer mount hole 26. Locking projections 42 are formed on the lower surface of the base 41 and correspond in number and location to the cavities 19 and terminal fittings 13. The locking projections 42 are formed on the lower surface of the base 41 and engage the terminal fittings 13 by projecting into the respective cavities 19. A mount-maneuvering projection 43 is provided on the upper surface of the rear end of the base 41 with respect to the inserting direction of the retainer 40 into the terminal accommodating portion 11. The mount-maneuvering projection 43 can be pushed from the side by a jig when the retainer 40 is to be mounted. A thin detach-maneuvering piece 44 is provided on the rear surface of the base 41 with respect to the inserting direction and can be pushed in a direction opposite to the insertion direction of the retainer 40 by a jig when the retainer 40 is to be detached. The side surface at the rear end of the retainer 40 with respect to the inserting direction is moderately arcuate.

Figure 8:
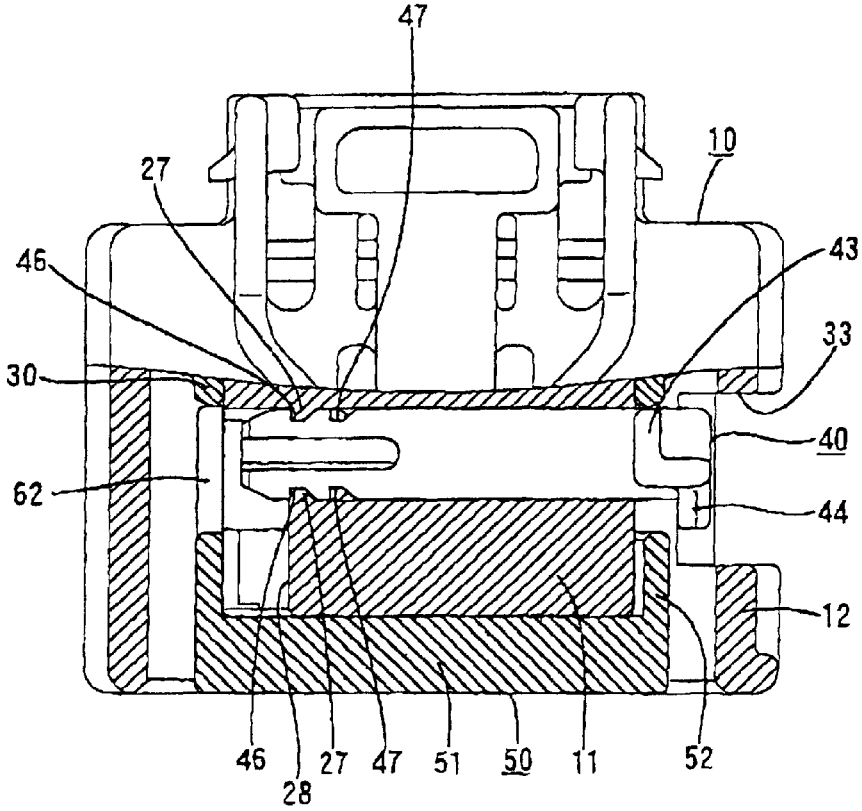
FIG. 8 is a section along 8—8 of FIG. 7.
Figure 10:
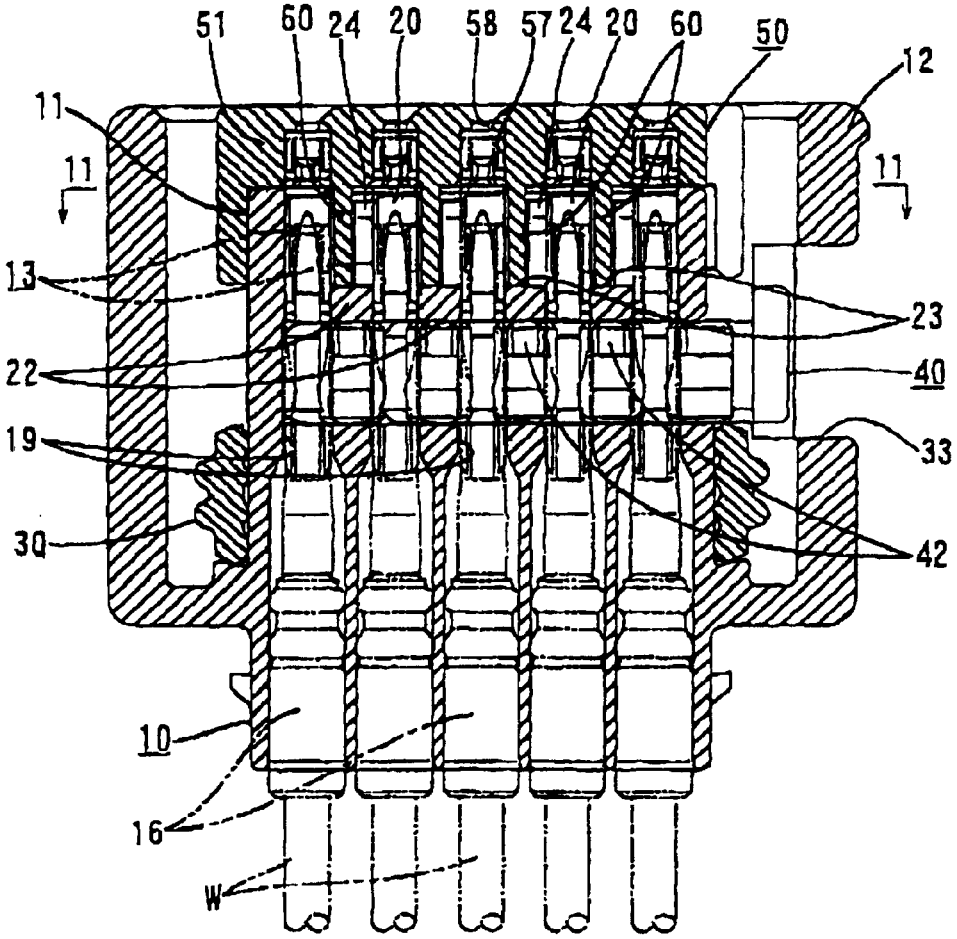
FIG. 10 is a section along 10—10 of FIG. 7.

Two first holding recesses 46 and two second holding recesses 47 are formed in this order in the lateral surfaces of the front side of the base 41 with respect to the inserting direction, as shown in FIG. 5. The retainer 40 can be held in a partial locking position or a full locking position in the terminal accommodating portion 11 by engaging the first holding recesses 46 or the second holding recesses 47 with the holding projections 27 in the retainer mount hole 26. Specifically, as shown in FIG. 8, the retainer 40 is held at the partial locking position when the first holding recesses 46 engage the holding projections 27. In this state, the respective locking projections 42 are retracted from the cavities 19 and are located substantially at the same positions as the partition walls 22, as shown in FIG. 10. Thus, insertion and withdrawal of the terminals 13 into and from the cavities 19 is permitted.

Figure 13:
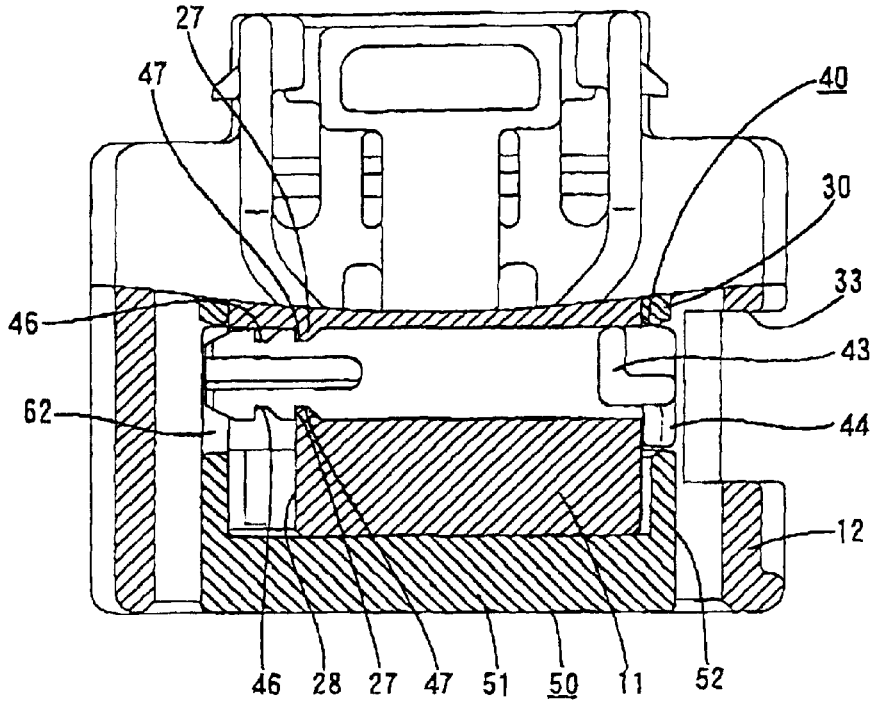
FIG. 13 is a section along 13—13 of FIG. 12.
Figure 14:
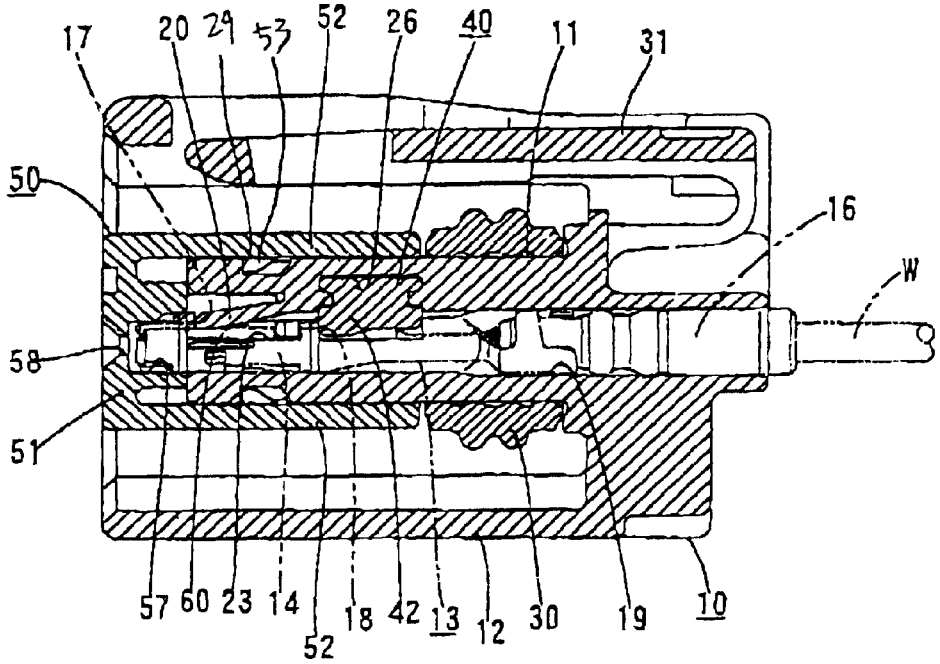
FIG. 14 is a section along 14—14 of FIG. 12.

The retainer 40 can be moved to the full locking position where the second holding recesses 47 are engaged with the holding projections 27 as shown in FIG. 13. In this state, the respective locking projections 42 enter the cavities 19 to engage the jaws 18 at the rear ends of the connecting portions 14 of the terminal fittings 13, as shown in FIG. 14. The locking projections 42 are slightly narrower than the partition walls 22. Thus, the locking projections 42 are engaged with the jaws 18 of the terminal fittings 13 substantially over the entire width.

Figure 6:
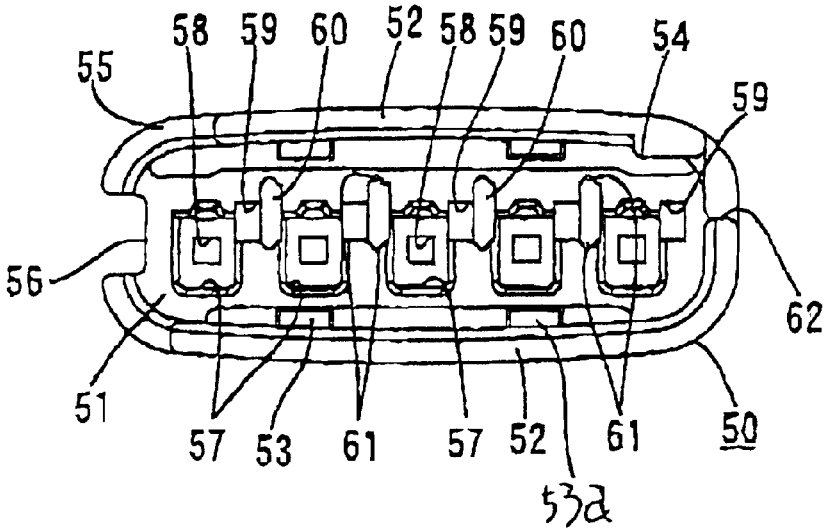
FIG. 6 is a rear view of the holding member.
Figure 11:
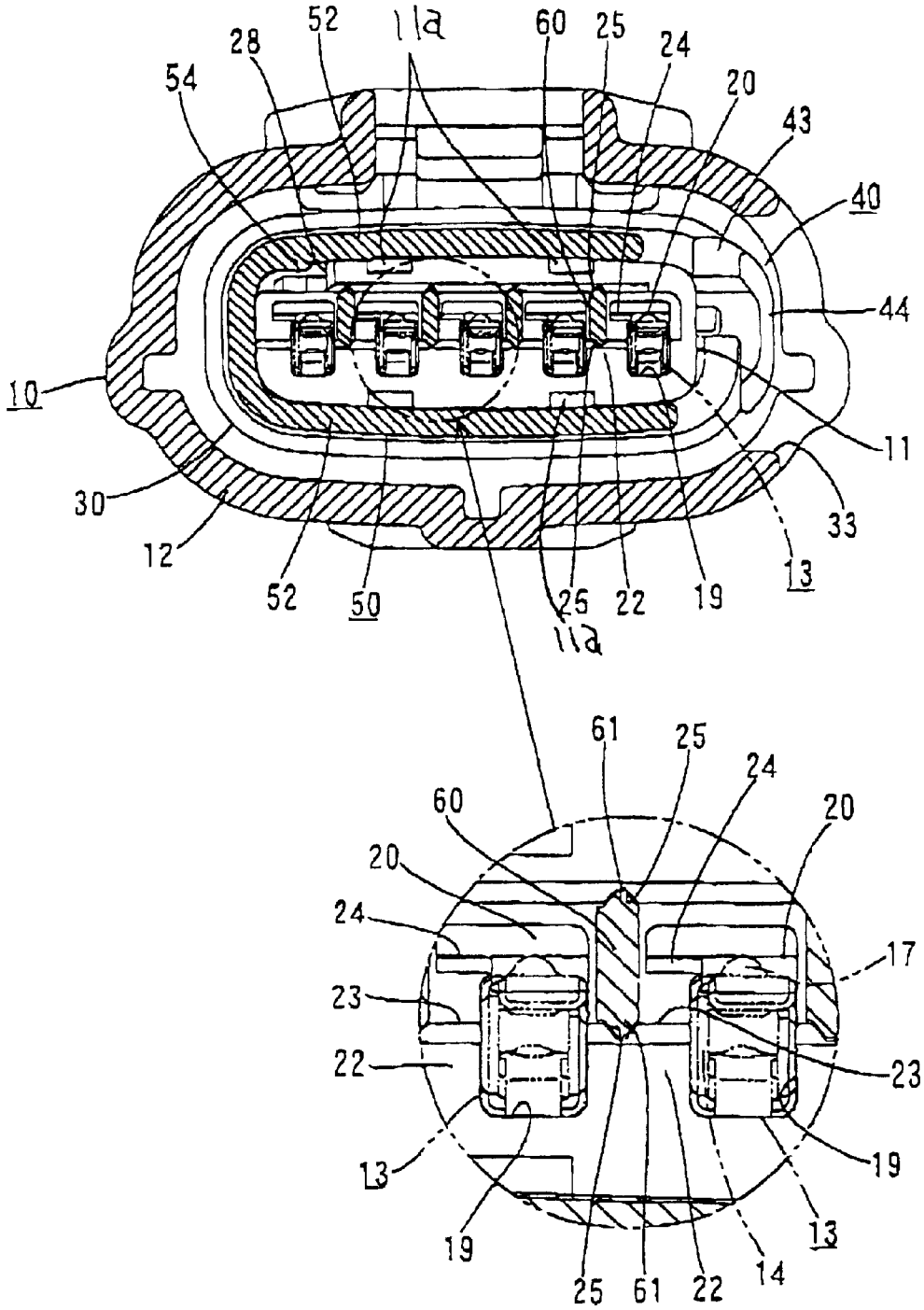
FIG. 11 is a section along 11—11 of FIG. 10.
Figure 12:
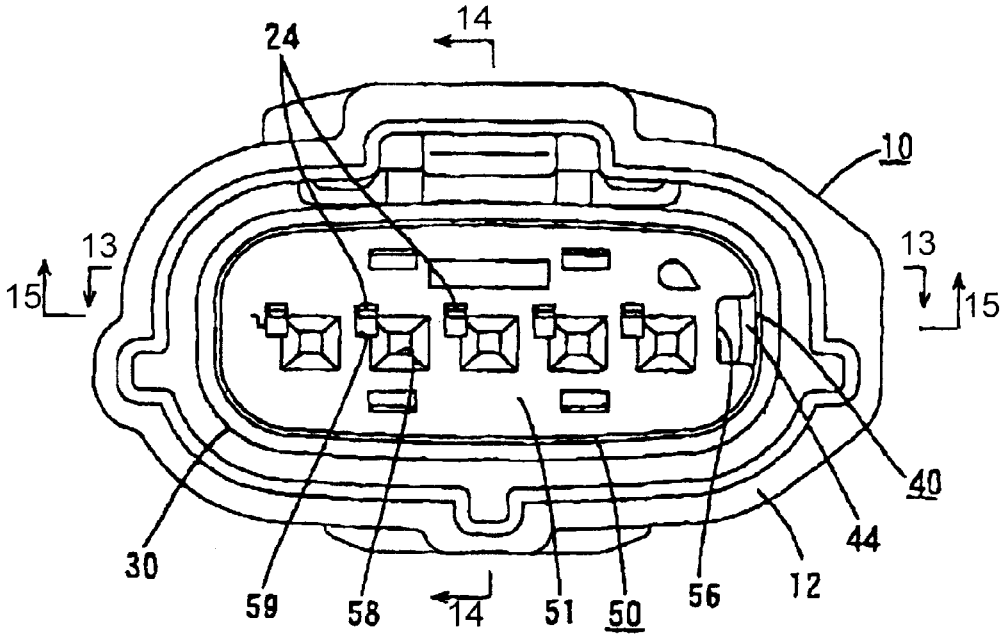
FIG. 12 is a front view showing a state where the retainer is at a full locking position.

A synthetic resin holder 50 has a substantially elliptical front wall 51, as shown in FIG. 6, and a substantially tubular holding plate 52 projects back from the front wall 51. The holding plate 52 is fittable on the outer surface of the terminal accommodating portion 11 as shown in FIG. 4, and two holding projections 53 are provided on each of the inner upper and lower surfaces of the holding plate 52. The holder 50 is held to the terminal accommodating portion 11 by engaging the holding projections 53 with the holding grooves 29 in the terminal accommodating portion 11. The holding projections 53 can move smoothly onto the terminal accommodating portion 11 by providing a slanted rear end surface 53*a* for each holding projection 53 for sliding contact with the corresponding surface 11*a* of the terminal accommodating portion 11. However, a large locking force can be achieved by forming a front end surface 53*b* of each holding projection 53 substantially normal to the holder fitting direction HFD for engagement with the front end surface 29*a* of the corresponding holding groove 29. In this state, the holding plate 52 engages the front end surface of the rubber ring 30 to prevent the rubber ring 30 from coming out (see FIG. 9). A bulging portion 54 is provided at the inner surface of a right end portion of the upper part of the holding plate 52 in FIG. 6 and enters the mold-removal hole 28 of the terminal accommodating portion 11, as shown in FIG. 11. A communicating portion 55 opens sideways at the left end of the holding plate 52 in FIG. 6 and communicates with the retainer mount hole 26 and the retainer insertion hole 33. A jig insertion recess 56 is formed in the front wall 51 before the communication portion 55, as shown in FIG. 12, and allows the detach-maneuvering piece 44 of the retainer 40 at the full locking position to be exposed forward to outside and permits insertion of a jig to manipulate the detach-maneuvering piece 44. An escaping recess 62 is formed in the right side of the holding plate 52, as shown in FIG. 6, and is opposite the communicating portion 55 for escaping the leading end of the base portion 41, as shown in FIG. 13, when the retainer 40 is moved to its full locking position.

Figure 7:
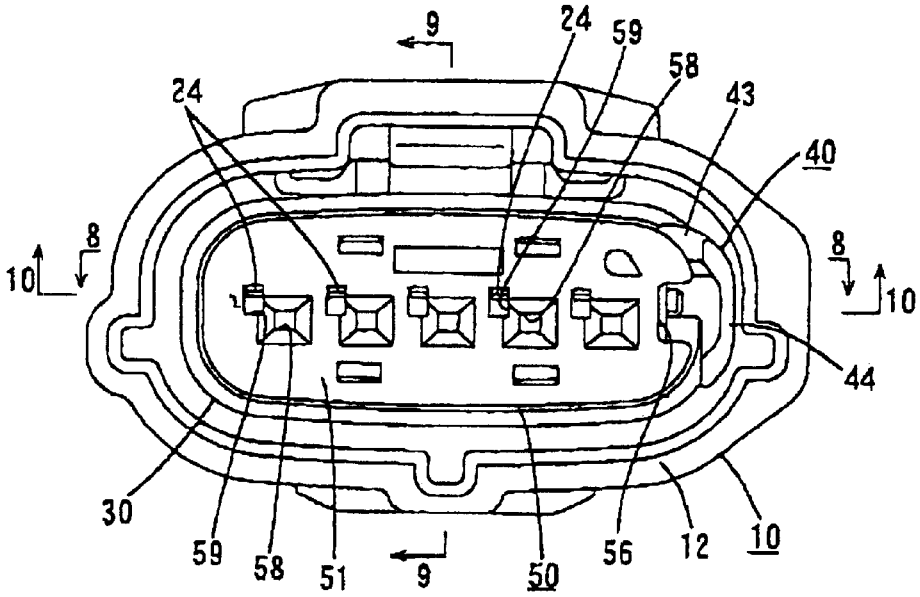
FIG. 7 is a front view showing a state where the retainer is mounted at a partial locking position on the housing main body in which the holding member is mounted.

Fitting recesses 57 are formed substantially side-by-side in the front wall 51 of the holder 50 and align with the cavities 19, as shown in FIGS. 3 and 4. Thus, the fitting recesses 57 receive and support the front ends of the corresponding terminal fittings 13 that project forward from the terminal accommodating portion 11 to prevent loose movement of the terminal fittings 13 in vertical, lateral and forward directions. Insertion holes 58 are formed through the front wall 51 of the holder 50 in center positions of the respective fitting recesses 57, as shown in FIGS. 4 and 6. The insertion holes 58 accommodate the male terminal fittings of the mating male connector. Jig insertion holes 59 communicate with the upper right portions of the fitting recesses 57 in FIG. 6 and penetrate the front wall 51 longitudinally along the insertion direction. The jig insertion holes 59 expose the unlocking pieces 24 of the locks 20 and permit insertion of the jig from the front to manipulate the unlocking pieces 24, as shown in FIG. 7. The jig insertion holes 59 are displaced obliquely from the insertion holes 58. Thus, the male terminal fittings are unlikely to enter the jig insertion holes 59 erroneously even if the mating male connector is inclined during connection of the two connectors.

Four partition walls 60 project back from the rear surface of the front wall 51. Each partition wall 60 is disposed at the right side of a respective one of the jig insertion holes 59 and at the left side of the corresponding fitting recesses 57, as shown in FIG. 6. The partition walls 60 move along a partition insertion direction as the holder 50 is mounted on the terminal accommodating portion 11 and then enter the respective the notches 23, as shown in FIG. 11. The partition walls 60 can be inserted into the notches 23 until the rear ends of the partition walls 60 contact the back ends of the notches 23. Thus, the partition walls 60 completely close the notches 23. The partition walls 60 insulate the terminal fittings 13 in adjacent cavities 19 from each other, and side surfaces of the partition walls 60 form parts of the side surfaces of the cavities 19. The partition walls 60 are about half as wide as the partition walls 22, and are dimensioned to provide minimum clearances between the partition walls 60 and both the locks 20 and the unlocking pieces 24. More specifically, the left side surfaces of the partition walls 60 in FIG. 10 are recessed slightly from inner side surfaces of the fitting recesses 57 and the cavities 19. Thus, the partition walls 60 do not hinder deformation of the locks 20.

Substantially triangular positioning projections 61 extend up and down from upper and lower sides of each partition wall 60, as shown in FIG. 11. The positioning projections 61 engage in the V-shaped positioning grooves 25 in the notches 23 to position the partition walls 60 laterally. Small horizontal portions remain at the left sides of the upper and lower surfaces of the partition walls 60 in FIG. 11 adjacent the partitioning projections 61. These horizontal portions contact the upper and lower surfaces of the notches 23.

The female connector is assembled by first mounting the rubber ring 30 on the outer surface of the terminal accommodating portion 11 of the housing 10. The rubber ring 30 passes the holding grooves 29 with little likelihood of being caught, as compared to a case where holding projections are provided instead of the holding grooves 29. Therefore, the rubber ring 30 can be mounted smoothly.

Figure 9:
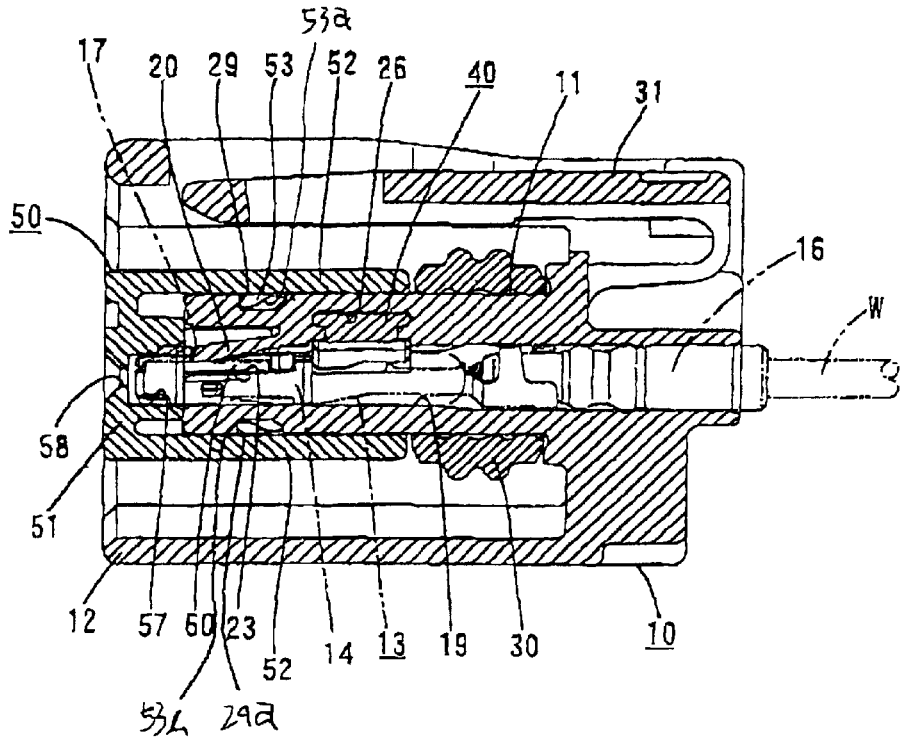
FIG. 9 is a section along 9—9 of FIG. 7.

The inner surface of the holding plate 52 of the holder 50 then is fitted on the outer surface of the terminal accommodating portion 11 from the front. More particularly, the rear end surfaces 53*a* of the holding projections 53 of the holding plate 52 move into sliding contact with the slanted surfaces 11*a* of the terminal accommodating portion 11. After sufficient movement, the holding projections 53 enter the holding grooves 29, as shown in FIG. 9. Thus, the front surfaces 53*b* of the holding projections 53 engage the front surfaces 29*a* of the holding grooves 29 to hold the holder 50 on the terminal accommodating portion 11. At this stage, the rear end of the holder 50 engages the front surface of the rubber ring 30 to hold the rubber ring 30 in position. During this process, the upper and lower positioning projections 61 of the partition walls 60 move into the positioning grooves 25 of the corresponding notches 23, as shown in FIGS. 10 and 11. As a result, the partition walls 60 are inserted smoothly into the notches 23 and are positioned laterally to avoid interference with the locks 20 and the unlocking pieces 24. The partition walls 60 are inserted until their rear ends contact the rear ends of the notches 23 and align with the base ends of the locks 20. Consequently, the partition walls 60 partition adjacent cavities 19 and form the side surfaces of the cavities 19. In this state, the front surface of the holder 50 and the front surface of the housing 10 are substantially flush with each other.

The retainer 40 is inserted laterally through the retainer insertion hole 33 of the receptacle 12 and into the retainer mount hole 26 of the terminal accommodating portion 11. Insertion of the retainer 40 is stopped at the partial locking position with the first holding recesses 46 engaging the holding projections 27, as shown in FIG. 8. At this stage, the rear end of the retainer 40, with respect to the inserting direction RID, is between the holder 50 and the receptacle 12 and can be seen from the front. It does not matter which of the holder 50 and the retainer 40 is mounted first.

Figure 15:
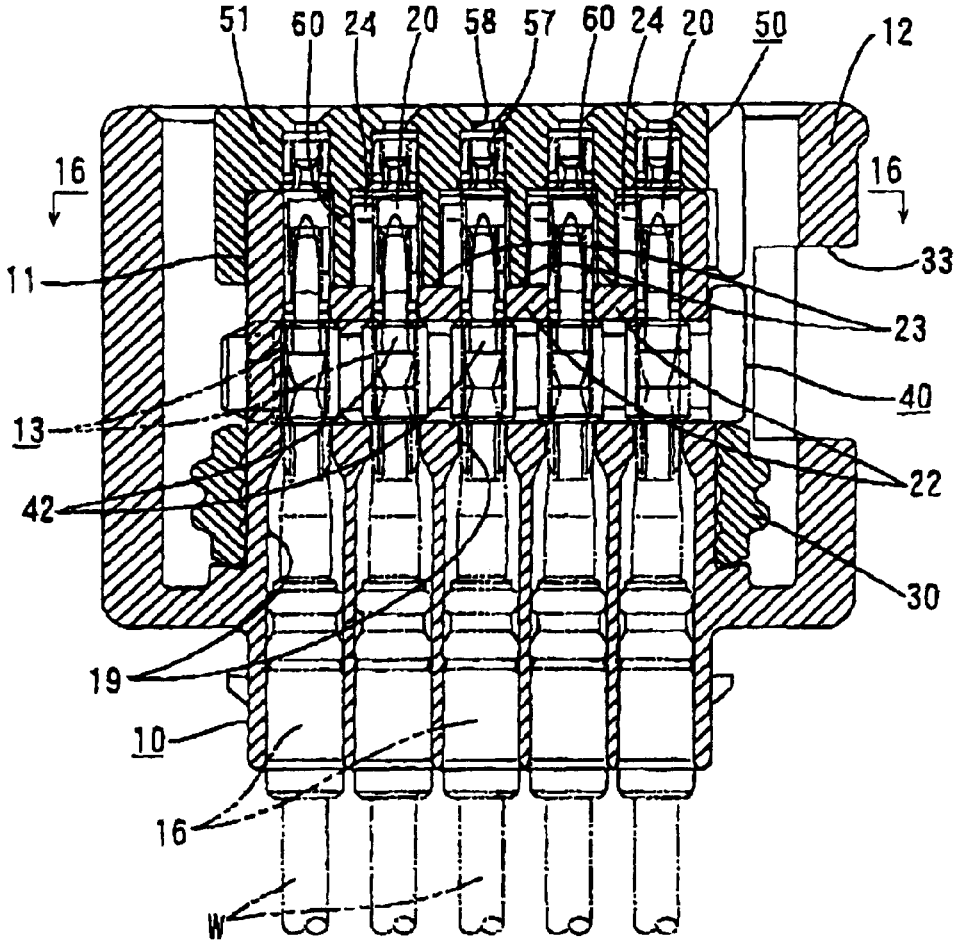
FIG. 15 is a section along 15—15 of FIG. 12.
Figure 16:
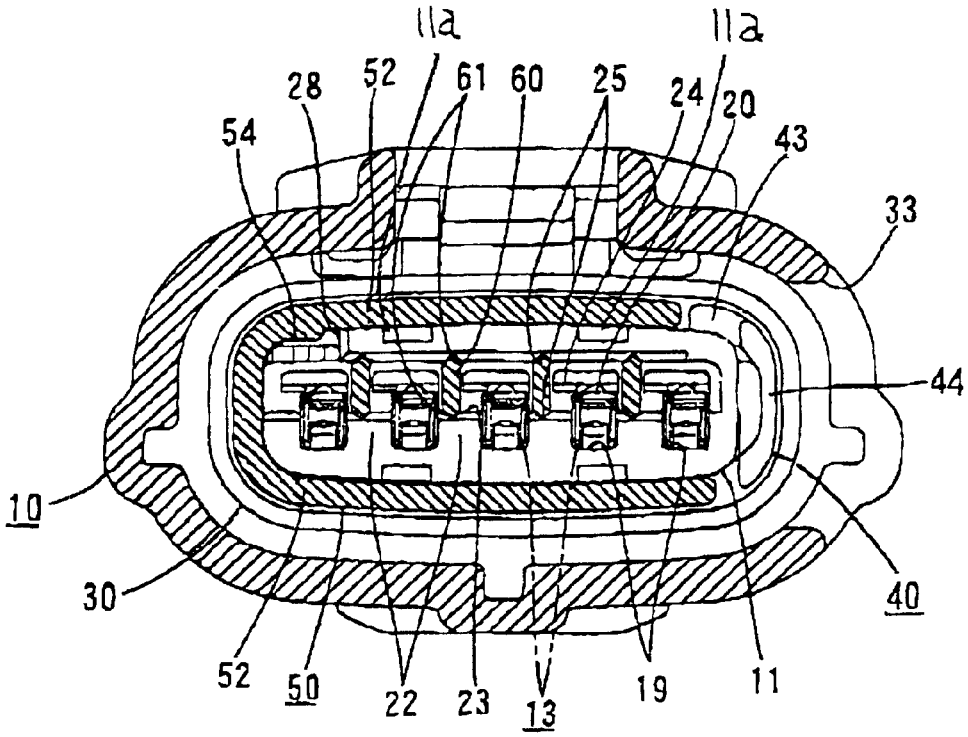
FIG. 16 is a section along 16—16 of FIG. 15.

Assembly proceeds by inserting the terminal fittings 13 into the cavities 19. Connecting portions 14 of the terminal fittings 13 push the locks 20 at an intermediate stage of insertion and deform the locks 20 into the deformation permitting spaces 21 above the cavities 19. The locks 20 are restored resiliently when the terminal fittings 13 reach a proper depth, and the restored locks 20 engage the engaging portions 17 of the terminal fittings 13, as shown in FIG. 9. Thus, the terminal fittings 13 are partially locked in the cavities 19. At this time, the front ends of the terminal fittings 13 are in the fitting recesses 57 of the holder 50, as shown in FIGS. 9 and 10. As a result, the terminal fittings 13 are supported and cannot move forward any further. The partition walls 60 close the notches 23, and hence the terminal fittings 13 are insulated from the terminal fittings 13 in adjacent cavities 19. A jig then can be inserted sideways through the retainer insertion hole 33 to push the mount-maneuvering projection 43 of the retainer 40. Thus, the first holding recesses 46 disengage from the holding projections 27 and the second holding recesses 47 engage the holding projections 27 to hold the retainer 40 at the full locking position shown in FIG. 13. In this position, the locking projections 42 of the retainer 40 project into the cavities 19 and engage the jaws 18, as shown in FIGS. 14 and 15, to doubly lock the terminal fittings 13.

All of the rear end of the retainer 40, except for the detach-maneuvering piece 44, becomes concealed by the holder 50 and cannot be seen from front when the retainer 40 reaches the full locking position. Thus, an operator can detect that the retainer 40 has reached the full locking position. In this state, the rear surface of the retainer 40, with respect to the inserting direction, is substantially flush with the side surface of the holder 50.

The terminal fittings 13 can be detached for maintenance or another reason by first moving the retainer 40 from the full locking position to the partial locking position. The retainer 40 can be moved to the partial locking position by manipulating the detach-maneuvering piece 44 of the retainer 40 with a jig inserted through the jig insertion recess 56 of the holding member 50 from the front. The lock 20 then is deformed and disengaged from the engaging portion 17 of the terminal fitting 13 by inserting a different jig into the jig insertion hole 59 of the holder 50 from the front and pushing the unlocking piece 24 of the lock 20. The terminal fittings 13 then are pulled out of the cavity 19.

As described above, the holding grooves 29 in the terminal accommodating portion 11 are exposed laterally to the outside through the retainer insertion hole 33 in the receptacle 12, and the mold for molding the holding grooves 29 is removed through the retainer insertion hole 33. Thus, the holding grooves 29 can be molded without forming special mold-removal holes for the holding grooves 29 in the housing 10.

Further, the holding grooves 29 are formed for engagement by the holding projections 53 on the holder 50. The rubber ring 30 must be moved behind the holding groove 29 for proper mounting. However, the rubber ring 30 is less likely to get caught by the holding grooves 29 than by holding projections. Therefore, the rubber ring 30 can be mounted with an improved operability and has a lower chance of being damaged.

The present invention is not limited to the above described and illustrated embodiment. For example, following embodiments also are embraced by the technical scope of the present invention as defined in the claims. Beside the following embodiments, various changes can be made without departing from the scope and spirit of the present invention as defined in the claims.

As a modification of the foregoing embodiment, rearwardly-projecting protruding portions 70 may be formed at the rear ends of the partition walls 60 and recesses 71 for receiving the protruding portions 70 may be formed in the back end surfaces of the notches 23 as shown in FIG. 17.

The partition walls 60 are formed with the substantially triangular positioning projections 61 that conform with the substantially V-shaped positioning grooves 25 in the foregoing embodiment. However, the positioning grooves 25 and the positioning projections 61 may be, for example, rectangular or semicircular. Further, positioning protrusions may be formed on the upper and lower surfaces of each notch 23 and the partition wall 60 may be positioned between two positioning protrusions according to the invention.

The holder 50 locks the rubber ring 30 in the foregoing embodiment. However the holder 50 also is applicable to a connector with no rubber ring.

Although the female connector has the receptacle 12, the present invention is also applicable to female connectors with no receptacle.

Although the female connector is described in the foregoing embodiment, the present invention is also applicable to male connectors.

Although the holding grooves 29 are formed in the outer surfaces of the terminal accommodating portion 11 in the foregoing embodiment, holding projections may be provided on the outer circumferential surfaces of the terminal accommodation portion 11 to hold the holder 50.

What is claimed is:

1. A connector, comprising:

a housing having a terminal accommodating portion with opposite front and rear ends and substantially parallel cavities extending between the ends, a retainer mount hole extending transversely into the terminal accommodating portion and intersecting the cavities such that the retainer mount hole extends substantially normal to the cavities, a holding groove formed in an outer surface of the terminal accommodating portion and being aligned substantially parallel to the retainer mount hole, a receptacle at least partly surrounding the terminal accommodating portion and having a retainer insertion hole dimensioned and disposed such that extensions of the retainer mount hole and the holding groove align with and pass through the retainer insertion hole; and a holder mounted onto the front end of the terminal accommodating portion and having holding projections engaged in the holding groove for holding the holder on the terminal accommodating portion.

2. The connector of claim 1, wherein the holder is mounted on the terminal accommodating portion along a holder fitting direction, and wherein the holding groove comprises a front end surface aligned at an angle between about 70° to about 110° to the holder fitting direction, the front end surface engaging a mating surface of the projection, the mating surface being at an angle to the holder fitting direction substantially equal to the angle of the front end surface.

3. The connector of claim 2, wherein the projection comprises a slanted portion for sliding contact with a corresponding portion of the terminal accommodating portion.

4. The connector of claim 1, further comprising a sealing ring mounted around the terminal accommodating portion between the holding groove and the rear end of the terminal accommodating portion, the sealing ring being dimensioned for close contact with the housing and a mating housing inserted between the terminal accommodating portion and the receptacle.

5. The connector of claim 4, wherein the groove comprises a front end surface aligned substantially normal to a holder fitting direction for fitting the holder on the terminal accommodating portion, the front end surface engaging a mating surface of the projection, the mating surface being substantially normal to the holder fitting direction.

6. The connector of claim 5, wherein the holding projections comprise slanted surfaces for sliding contact with a corresponding portion of the terminal accommodating portion.

7. The connector of claim 4, further comprising a retainer mounted in the retainer mount hole.

* * * * *